US012342880B1

(12) United States Patent
Fujiwara et al.

(10) Patent No.: US 12,342,880 B1
(45) Date of Patent: Jul. 1, 2025

(54) BARRIER LAYER FOR GARMENTS AND ARTICLES

(71) Applicant: KJUS North America, Inc., Fairhaven, MA (US)

(72) Inventors: Shogo Fujiwara, Westminster, CO (US); Colin Beard, Denver, CO (US); Jessica Musto, Boulder, CO (US); Tucker Sutter, Broomfield, CO (US); Amanda Frank, Erie, CO (US)

(73) Assignee: KJUS North America, Boulder, CO (US)

( * ) Notice: Subject to any disclaimer, the term of this patent is extended or adjusted under 35 U.S.C. 154(b) by 5 days.

(21) Appl. No.: 18/392,145

(22) Filed: Dec. 21, 2023

(51) Int. Cl.
*A41D 1/06* (2006.01)
*A41D 17/02* (2006.01)
*A41D 31/10* (2019.01)

(52) U.S. Cl.
CPC ..... *A41D 17/02* (2013.01); *A41D 1/06* (2013.01); *A41D 31/10* (2019.02)

(58) Field of Classification Search
CPC ..... A41D 17/005; A41D 15/002; A41D 1/06; A41D 13/06; A41F 17/04; A43B 3/166; A41B 11/08
See application file for complete search history.

(56) References Cited

U.S. PATENT DOCUMENTS 448,819 A * 3/1891 Macomber ..... A41D 17/00 24/72.1
RE13,747 E * 6/1914 Woodward ..... 2/61
1,749,789 A * 3/1930 Wheeler ..... A41D 17/02 36/2 B
1,794,506 A * 3/1931 Anderson ..... A41D 17/00 2/61
1,801,562 A * 4/1931 Luft ..... A41F 17/04 2/232
2,237,307 A * 4/1941 Kimball ..... A41D 17/02 36/2 B
2,294,842 A * 9/1942 Beecher ..... A41D 17/005 24/267
2,406,090 A * 8/1946 Mas ..... A41D 17/00 D2/901
2,422,851 A * 6/1947 Randall ..... A41D 17/02 36/2 R
2,532,024 A * 11/1950 Hoffman ..... A41D 17/00 36/2 R
2,779,108 A * 1/1957 Twiss ..... A41D 17/02 36/2 B
3,128,565 A * 4/1964 Graham ..... A41D 17/02 2/242

(Continued)

FOREIGN PATENT DOCUMENTS

CN 2787024 6/2006
JP 8176908 7/1996

(Continued)

*Primary Examiner* — Jillian K Pierorazio

(57) ABSTRACT

An article of apparel comprising a lower garment with a deployable barrier layer. The deployable barrier layer may comprise a flap attached to an interior region of the lower garment. The flap may be deployed to cover an upper portion of a subject's foot or an article of footwear worn by a subject wearing the article of apparel.

20 Claims, 6 Drawing Sheets

(56) References Cited

U.S. PATENT DOCUMENTS

| | | | | | |
|---|---|---|---|---|---|
| 3,153,864 | A * | 10/1964 | Brewer | A41D 17/00 | 2/22 |
| 4,149,275 | A * | 4/1979 | Sanchez | A41D 1/06 | 2/269 |
| 4,856,207 | A * | 8/1989 | Datson | A41D 17/00 | 36/87 |
| 4,896,379 | A * | 1/1990 | Kape | A41D 1/06 | 2/269 |
| 5,005,215 | A * | 4/1991 | McIlquham | A41D 17/02 | 2/22 |
| 5,539,932 | A | 7/1996 | Howard | | |
| 5,887,359 | A * | 3/1999 | Falguere | A41D 17/00 | 36/1.5 |
| 6,185,752 | B1 * | 2/2001 | Hendersen | A41D 17/00 | 2/242 |
| 6,560,781 | B1 * | 5/2003 | Keene | A63B 71/1225 | 2/22 |
| D520,218 | S * | 5/2006 | Mayers | D2/901 | |
| 7,051,374 | B1 * | 5/2006 | Grilliot | A62B 17/001 | 2/69 |
| 8,028,351 | B2 * | 10/2011 | Stachler | A62B 17/006 | 2/457 |
| D669,663 | S * | 10/2012 | Miller | D2/901 | |
| 10,660,380 | B1 * | 5/2020 | Wendling | A41D 1/06 | |
| 2002/0174565 | A1 * | 11/2002 | Roelofs | A43C 11/12 | 36/2 R |
| 2003/0093918 | A1 * | 5/2003 | Challe | A43B 3/0031 | 36/1.5 |
| 2004/0055074 | A1 * | 3/2004 | Lin | A41D 17/005 | 2/242 |
| 2012/0180183 | A1 * | 7/2012 | Mechling | A63B 71/1225 | 2/22 |
| 2012/0185998 | A1 * | 7/2012 | Hagen | A41D 17/005 | 2/227 |
| 2017/0065009 | A1 * | 3/2017 | Kim | A43C 15/06 | |
| 2018/0071173 | A1 * | 3/2018 | Hunter | A41D 19/01 | |
| 2018/0168250 | A1 * | 6/2018 | Ly | A41D 15/002 | |
| 2018/0213868 | A1 * | 8/2018 | Eldredge | A41F 19/005 | |
| 2018/0352878 | A1 * | 12/2018 | Smith | A41D 13/0005 | |
| 2019/0150535 | A1 * | 5/2019 | Shorten | A41D 17/005 | |
| 2019/0174835 | A1 * | 6/2019 | Johnson, II | A41B 7/02 | |
| 2019/0246713 | A1 * | 8/2019 | Pinto Rodrigues | D04B 1/26 | |
| 2020/0337413 | A1 * | 10/2020 | Anderson | A41D 27/20 | |
| 2021/0360985 | A1 * | 11/2021 | Prushiek | A41D 11/00 | |
| 2023/0276876 | A1 * | 9/2023 | Postolek | A41D 17/005 | 36/2 R |
| 2023/0397691 | A1 * | 12/2023 | Stoddard | A43B 3/166 | |

FOREIGN PATENT DOCUMENTS

| | | |
|---|---|---|
| JP | 978317 | 3/1997 |
| JP | 2007277761 | 10/2007 |
| JP | 2011226000 | 11/2011 |
| KR | 100742397 | 7/2007 |
| KR | 200453983 | 6/2011 |
| KR | 101623120 | 5/2016 |
| KR | 20220129751 | 9/2022 |
| WO | 2007144907 | 12/2007 |

* cited by examiner

BARRIER LAYER FOR GARMENTS AND ARTICLES

BACKGROUND

The characteristics and/or conditions of an environment can affect or influence the comfort, mental state, and/or physical abilities of a subject located in the environment. In some cases, the characteristics and/or conditions of a particular environment can also change or vary over time and space. In some cases, a subject may want and/or need to wear garments or articles that can shield or insulate the subject's body, gear, equipment, and/or outfit from external water, moisture, and/or various types or forms of precipitation present within an environment.

SUMMARY

The present disclosure generally relates to garments and articles that can be configured to shield or insulate (i) a subject's body, (ii) a subject's gear or equipment, and/or (iii) one or more other articles worn by the subject from external water, moisture, and/or precipitation. In some cases, the one or more other articles may include an article that can be attached to, secured around, or positioned over or along a portion of the subject's body. In some cases, the one or more articles may include, for example, an article of footwear as described elsewhere herein. In some cases, the garments and articles of the present disclosure may incorporate and/or utilize a barrier layer that can be deployed to enhance the overall waterproofness and/or water-resistance of a subject's outfit. In some cases, the presently disclosed garments and articles may incorporate and/or utilize a barrier layer that can be stored or stowed away inside a garment or article worn by the subject when the barrier layer is no longer needed or required.

Many conventional garments and articles may not have an integrated barrier layer, which means that a subject may need to use a separate barrier layer component to shield or insulate certain parts of the subject's body from external materials, substances, climates, and/or weather conditions. In many cases, it may not be ideal for a subject to carry, store, and/or look after a separate barrier layer component that is not integrally formed with another article or garment that the subject is wearing or planning to wear. Some conventional garments and articles may incorporate or utilize a barrier layer that can be integrated with an article or garment that the subject is wearing or planning to wear. However, many of these barrier layers cannot be stowed away or hidden, even in situations where it would not be practical or necessary to use the barrier layers (e.g., due to changes or variations in the environmental conditions). If the barrier layers cannot be stored, hidden, or moved out of the way, the barrier layers can also end up restricting or hindering the subject's movement in some cases, which can be bothersome, cumbersome, and even unsafe.

The present disclosure recognizes and addresses at least the above shortcomings and limitations of conventional barrier layers. In some non-limiting aspects, the present disclosure provides various examples and embodiments of garments and articles with an integrated barrier layer that can be (i) deployed to limit the entry of water, moisture, or precipitation into an interior region of one or more garments or articles worn by a subject, and (ii) stored or hidden away in an interior region of a garment or an article worn by the subject when the subject no longer wants or needs to use the barrier layer. The garments and articles of the present disclosure may utilize or incorporate the deployable barrier layers disclosed herein to give a subject the flexibility to decide whether to deploy the barrier layer or to stow the barrier layer away, without having to manage any separate barrier layer component. Further, the presently disclosed barrier layers may be positioned or stored within an interior region of a garment or an article worn by the subject in such a way that the barrier layers can be fully hidden from view and/or entirely moved out of the way when not in use.

In one aspect, the present disclosure provides an article of apparel comprising a lower garment. In some embodiments, the lower garment may comprise one or more leg portions with a bottom cuff comprising a shortened front cuff portion and a rain flap attached to or integrally formed with the shortened front cuff portion of the bottom cuff.

In some embodiments, the rain flap has a proximal end attached to the bottom cuff of the lower garment and a distal end opposite the proximal end. In some embodiments, the proximal end of the rain flap is attached to the interior region of the one or more leg portions of the lower garment. In some embodiments, the distal end of the rain flap is configured to cover an upper portion of an article of footwear worn by a subject wearing the article of apparel. In some embodiments, the distal end of the rain flap is configured to cover a lateral side portion of the article of footwear. In some embodiments, the distal end of the rain flap is configured to cover a medial side portion of the article of footwear. In some embodiments, the distal end of the rain flap comprises a waterproof and/or water-resistant material.

In some embodiments, the rain flap comprises a first side and a second side extending between the proximal end and the distal end of the rain flap. In some embodiments, the first side of the rain flap and the second side of the rain flap are non-parallel. In some embodiments, the first side of the rain flap is non-perpendicular with the proximal end and/or the distal end of the rain flap. In some embodiments, the second side of the rain flap is non-perpendicular with the proximal end and/or the distal end of the rain flap.

In some embodiments, the rain flap comprises an elastic portion provided between the proximal end and the distal end of the rain flap to enhance a stretchability of the rain flap or a flexibility of the distal end relative to the proximal end. In some embodiments, the elastic portion may be configured to stretch to a plurality of different lengths to allow the fastener to engage with a plurality of different sections or segments of the lace or the cable associated with the article of footwear.

In some embodiments, the elastic portion comprises a different material than the proximal end and/or the distal end of the rain flap. In some embodiments, the elastic portion comprises a stretchable material (e.g., elastane).

In some embodiments, the elastic portion may be positionable over an upper portion, a lateral side portion, and/or a medial side portion of the article of footwear. In some embodiments, the elastic portion may be configured to extend over an upper portion, a lateral side portion, and/or a medial side portion of the article of footwear. In some embodiments, the elastic portion may be positioned within the interior region of the one or more leg portions of the lower garment and/or above a bottom edge of the one or more leg portions of the lower garment when the rain flap is extended downwards and deployed to cover the upper portion, the lateral side portion, and/or the medial side portion of the article of footwear.

In some embodiments, the rain flap comprises a fastener for engaging a lace or a cable associated with the article of footwear. In some embodiments, the fastener comprises a hook or a latch. In some embodiments, the hook or latch may have a fixed position or orientation. In other embodiments, a position and/or an orientation of the hook or latch may be adjustable. In some optional embodiments, the rain flap may include a plurality of fasteners for simultaneously and/or independently engaging with a plurality of different sections or segments of the lace or the cable associated with the article of footwear.

In some embodiments, the rain flap is configured to fold about a lateral axis that is positionally offset from a bottom edge of the one or more leg portions of the lower garment. In some embodiments, the rain flap is configured to curve around and/or conform to the upper portion, the lateral side portion, and/or the medial side portion of the article of footwear to form a waterproof and/or water-resistant barrier.

In some embodiments, the rain flap comprises a plurality of magnetic attachment mechanisms integrated with the distal end of the rain flap. In some embodiments, the plurality of magnetic attachment mechanisms are configured to detachably couple the distal end of the rain flap to an interior region of the one or more leg portions of the lower garment to hide or conceal the rain flap.

In some embodiments, the lower garment comprises a plurality of complementary magnets configured to engage with the plurality of magnetic attachment mechanisms integrated with the distal end of the rain flap. In some embodiments, the plurality of complementary magnets are integrated into a layer or a panel of the lower garment. In some embodiments, the plurality of complementary magnets are attached to the interior region of the one or more leg portions of the lower garment.

Additional aspects and advantages of the present disclosure will become readily apparent to those skilled in the art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

BRIEF DESCRIPTION OF THE DRAWINGS

Non-limiting and non-exhaustive examples and embodiments of the present disclosure are described with reference to the following figures.

DETAILED DESCRIPTION

While various embodiments of the present disclosure have been shown and described herein, it will be obvious to those skilled in the art that such embodiments are provided by way of example only. Numerous variations, changes, and substitutions may occur to those skilled in the art without departing from the present disclosure. It should be understood that various alternatives to the examples and embodiments described herein may be employed.

Overview

The present disclosure provides various examples and non-limiting embodiments of a garment comprising a barrier layer. In some embodiments, the garment may comprise an article of apparel that can be worn by a subject engaging in one or more activities. In some cases, the one or more activities may be performed in an environment with water and/or moisture, or an environment with various types or forms of precipitation (e.g., drizzle, rain, sleet, snow, ice pellets, hail, etc.). In some cases, the one or more activities may include a physical activity (e.g., walking, running, hiking, skiing, snowboarding, golfing, etc.). In other cases, the one or more activities may include a non-physical activity (e.g., standing, sitting, resting, lying down, etc.) or any activity that either involves minimal movement or does not involve any active movement.

Lower Garment

In some non-limiting embodiments, the garment may comprise a lower garment. In some embodiments, the lower garment may include a pant, a trouser, shorts, leggings, or any other type of garment that can be worn to cover a subject's legs, hip, waist, midsection, or lower body. In some embodiments, the lower garment may comprise a garment configured to cover or surround at least a lower portion of a subject's body. In some embodiments, the lower portion of the subject's body may include, for example, a hip region, a waist region, a thigh region, an upper leg region, a lower leg region, a calf region, an ankle region, and/or a foot region of the subject's body.

Figure 1A:
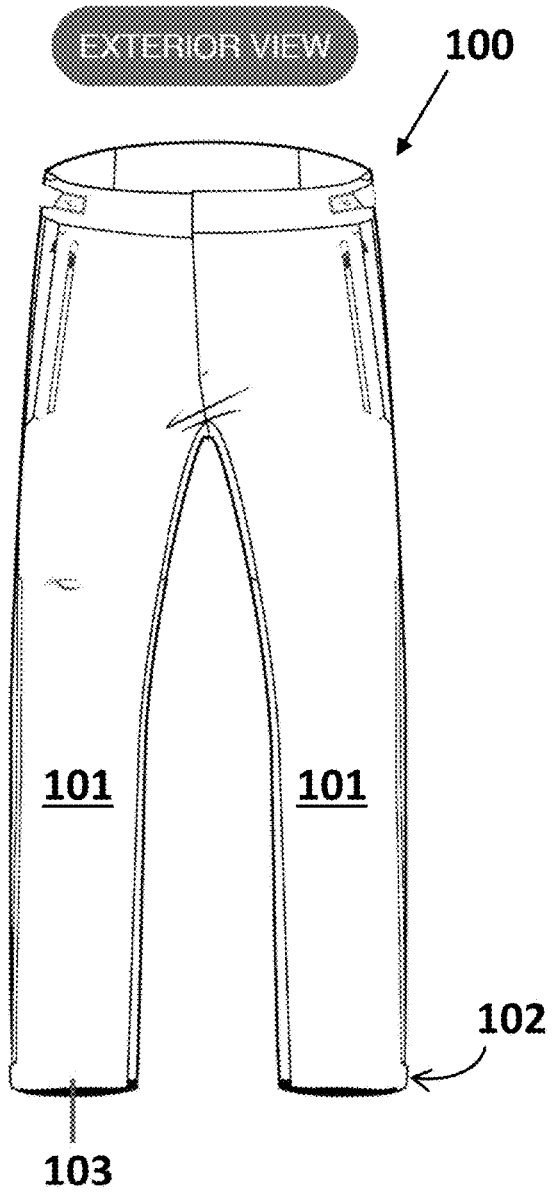
FIGS. 1A and 1B schematically illustrate an exterior view and an interior view of an exemplary garment or article that can incorporate or utilize a deployable barrier layer, in accordance with some embodiments.
Figure 1B:
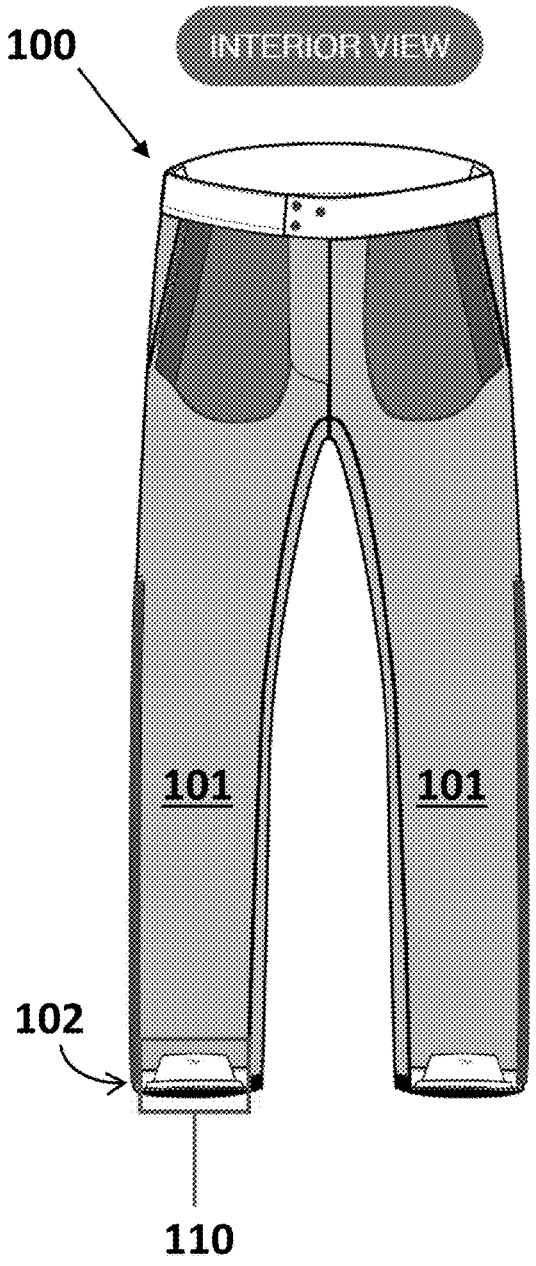

Referring to FIGS. 1A and 1B, in some embodiments, the garment may comprise a lower garment 100. In some cases, the lower garment 100 may include a pant or a trouser. In some cases, the pant or trouser may comprise one or more leg portions 101 with a bottom cuff 102. In some cases, the bottom cuff 102 may comprise a front cuff portion, a rear cuff portion, and/or one or more side cuff portions. In some cases, the front cuff portion may comprise a shortened front cuff portion 103. In some cases, the shortened front cuff portion 103 may be shorter in length than the rear cuff portion and/or the one or more side cuff portions of the bottom cuff 102. In some cases, the shortened front cuff portion 103 may not or need not extend all the way to the bottom edge of the bottom cuff 102.

In some embodiments, the lower garment may include an adjustment system provided along the bottom cuff region of the lower garment. In some embodiments, the adjustment system may include a strap that can be adjustably secured around the bottom cuff region of the lower garment (e.g., using one or more hook and loop fasteners or any other mechanical or magnetic fasteners as described elsewhere herein). In some embodiments, the adjustment system may include a strap that extends from a front facing portion or a side facing portion of the bottom cuff towards a rear facing portion of the bottom cuff. In some cases, the strap may comprise (i) a first end that is integrated with the front facing portion or the side facing portion of the bottom cuff and (ii) a second end that is attachable to the rear facing portion of the bottom cuff to draw the front and side facing portions of the bottom cuff around and over the lower leg and ankle regions of the subject's body. In some cases, the strap may be used to reduce the amount of free space between the bottom edges of the bottom cuff and the subject's lower leg or ankle regions so that the bottom cuff of the lower garment can be more tightly secured around the subject's lower legs and/or ankles, thereby preventing or limiting the movement of water, moisture, and/or precipitation into the lower garment through the leg openings along the bottom cuff of the lower garment.

Barrier Layer

As shown in FIG. 1B, in some embodiments, the lower garment may comprise a barrier layer 110. In some embodiments, the barrier layer 110 may comprise a deployable barrier layer. In some embodiments, the deployable barrier layer may be deployed from the bottom cuff 102 of the lower garment. In some embodiments, the deployable barrier layer may be tucked and/or moved into the interior region of the lower garment for storage. In some embodiments, the deployable barrier layer may not or need not be visible from outside the garment when the barrier layer is tucked or moved into the interior region of the lower garment.

In some embodiments, a distal end of the deployable barrier layer may be detachably coupled to the interior region of the lower garment to keep the barrier layer out of sight and out of the way when the barrier layer is not in use. As described in greater detail below, the distal end of the deployable barrier layer may be detachably coupled to the interior region of the lower garment using one or more fasteners. In some embodiments, the one or more fasteners may include a mechanical fastener such as a snap fastener, a press stud, one or more buttons, a clip, a clasp, a latch, a hook, a loop, one or more hook and loop fasteners, a cord, a lace, or any other suitable mechanical fastener. In some non-limiting embodiments, the distal end of the deployable barrier layer may be detachably coupled to the interior region of the lower garment using one or more magnetic components or elements that are attached to or integrated with (i) the distal end of the barrier layer and/or (ii) the lower garment.

In some non-limiting embodiments, the barrier layer 110 may comprise a flap. In some embodiments, the flap may comprise a panel or a layer of material that can extend around or over an article of footwear worn by the subject. In some embodiments, the flap may be configured to provide a physical and/or thermal barrier between an external environment and an interior region of the lower garment or the article of footwear.

In some embodiments, the deployable barrier layer may include a rain flap. In some cases, the rain flap may comprise a waterproof or water-resistant barrier that is deployable to prevent a movement or ingress of water, moisture, precipitation, dirt, debris, wind, or air into the interior region of the lower garment and/or the article of footwear. In some cases, the rain flap may be deployed or secured around an article of footwear worn by a subject. In some cases, the rain flap may be extendable around an instep region of a subject's foot. In some cases, the rain flap may be extendable around a vamp region of an article of footwear worn by the subject. In some embodiments, the rain flap may be configured to curve around and/or conform to the instep region of the subject's foot or the vamp region of the article of footwear to form a waterproof or water-resistant barrier.

In some cases, the rain flap may be extendable around an instep region of a subject's foot. In some cases, the instep region may refer to and/or include an upper portion of the subject's foot that is disposed above an arch region of the subject's foot. In some cases, the instep region may refer to and/or include a portion of the top surface of the subject's foot that extends between the subject's toes and the subject's ankle. In some cases, the instep region may refer to and/or include a portion of the subject's foot that is disposed adjacent to a top center portion of the article of footwear (e.g., where the throat and/or the tongue of the article of footwear are located). In some cases, the instep region may include any portion of the subject's foot that extends (i) between a lateral side or edge and a medial side or edge of the subject's foot and (ii) between the subject's toes and the subject's ankle. In some cases, the instep region may include one or more side portions of the subject's foot that extend between the top center region of the subject's foot and the medial or lateral sides or edges of the subject's foot. In some cases, the instep region may include at least a top center portion of a midfoot region and/or a forefoot region of the subject's foot. In some cases, the instep region may include at least a medial side portion and/or a lateral side portion of the midfoot region and/or the forefoot region of the subject's foot. In some cases, the instep region may not or need not include the underside or bottom portion of the subject's foot. In some cases, the instep region may refer to and/or include only the portions of the subject's foot that are entirely above the bottom surface or underside of the subject's foot.

In some cases, the rain flap may be extendable around a vamp region of an article of footwear worn by the subject. In some cases, the vamp region may include and/or refer to an upper portion of the article of footwear that extends around or over the instep region of the subject's foot. In some cases, the vamp region may include and/or refer to a portion of the article of footwear that extends around or over an upper portion or a top surface of the subject's foot. In some cases, the vamp region may include and/or refer to a portion of the article of footwear that extends between a toe region of the article of footwear and a quarter or heel region of the article of footwear. In some cases, the vamp region may include and/or refer to any portion of the article of footwear that extends (i) between a lateral side or edge and a medial side or edge of the article of footwear and (ii) between the toe region and the quarter or heel region of the article of footwear. In some cases, the vamp region may include one or more side portions of the article of footwear that extend between the top center portion of the article of footwear and the medial or lateral sides or edges of the article of footwear. In some cases, the vamp region may extend along, over, and/or across a top center region of a midfoot portion and/or a forefoot portion of a subject's foot. In some cases, the vamp region may extend along, over, and/or across a medial side and/or a lateral side of the midfoot portion and/or the forefoot portion of the subject's foot. In some cases, the vamp region may not or need not include any portion of the article of footwear that extends below or underneath the bottom surface or underside of the subject's foot. In some cases, the vamp region may refer to and/or include only the portions of the article of footwear that extend entirely above and/or over the upper and/or side surfaces of the subject's foot.

In some embodiments, the barrier layer may comprise a panel or layer of material that can be attached or coupled to a portion of the lower garment. In some embodiments, the barrier layer may comprise a panel or layer of material that is attached or coupled to an inside surface portion of the lower garment. In some cases, the inside surface portion may correspond to an inner layer or lining of the lower garment. In some cases, the inner layer or lining may be configured to face or directly contact the subject's lower body. In some cases, the inner layer or lining may be positioned in close proximity to the subject's lower body or another article or garment that is positioned between the inner layer or lining and the subject's body.

In some embodiments, a portion of the barrier layer may be permanently affixed to the lower garment. In some cases, the barrier layer may be adhesively coupled to the interior region of the lower garment. In some cases, the barrier layer may be stitched to the interior region of the lower garment or coupled to the lower garment by way of one or more seams.

In some embodiments, a portion of the barrier layer may be detachably coupled to the lower garment. In some cases, the barrier layer may be attached to the interior region of the lower garment using an interlocking fastener (e.g., a snap closure, a press stud, or one or more buttons), a hook and loop fastener (e.g., Velcro), or one or more magnetic fasteners.

In some embodiments, the barrier layer may comprise a panel or layer of material that is integrally formed with an inner surface portion of the lower garment. In some non-limiting embodiments, the barrier layer and the inner surface portion of the lower garment may form a unitary, one-piece construction. In other non-limiting embodiments, the barrier layer and the inner surface portion of the lower garment may be separate pieces or components that can be integrated together to form a multi-piece construction.

In some non-limiting embodiments, the barrier layer may comprise a plurality of panels or layers of material that can be independently manipulated for deployment over multiple different portions of an article of footwear worn by the subject. In some embodiments, the plurality of panels or layers may be separately attached to the article of footwear when the barrier layer is extended and deployed. In some embodiments, the plurality of panels or layers may be separately attached to the interior region of the lower garment when the barrier layer is retracted or moved into the interior region for storage or concealment.

Flap Structure

Figure 2:
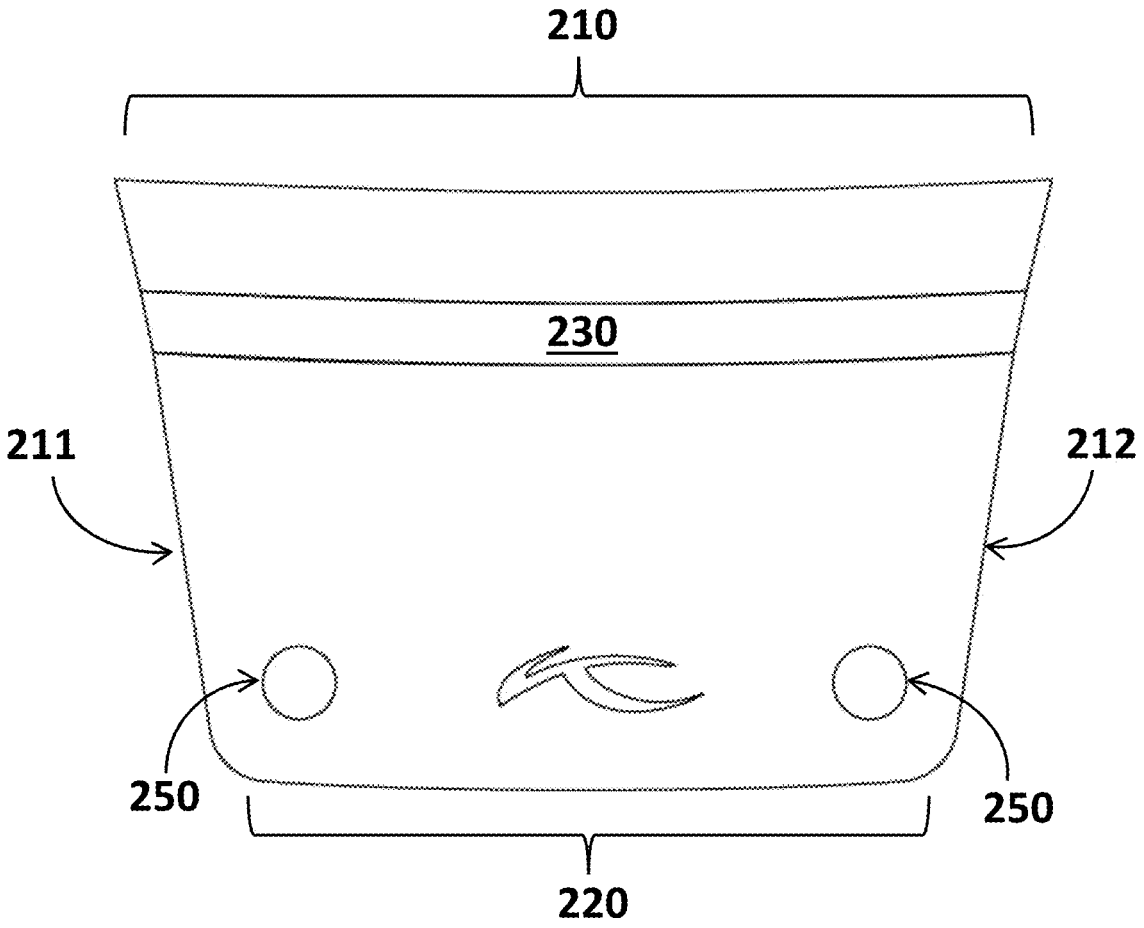
FIG. 2 schematically illustrates an example of a deployable barrier layer that can be incorporated into or integrated with a garment or an article, in accordance with some embodiments.

FIG. 2 illustrates an example of a barrier layer that can be configured as a rain flap. In some embodiments, the barrier layer may comprise a proximal end 210 and a distal end 220.

In some embodiments, the barrier layer may have a proximal end 210 attached to the bottom cuff of the lower garment. In some non-limiting embodiments, the proximal end 210 of the barrier layer may be attached to an interior region of the one or more leg portions of the lower garment.

In some embodiments, the proximal end 210 of the barrier layer may be directly attached to an interior portion of the lower garment. In some embodiments, the interior portion of the lower garment may correspond to an inner layer or a lining of the lower garment. In some embodiments, the proximal end 210 of the barrier layer may be attached to the inner layer or lining of the garment at an interior location or region that is proximal to the bottom cuff portion of the lower garment. In some embodiments, the proximal end 210 of the barrier layer may be attached or coupled to a shortened front cuff portion of the bottom cuff of the lower garment as described elsewhere herein.

In some embodiments, the barrier layer may have a distal end 220 that is positioned on an end of the barrier layer that is opposite the proximal end 210. In some embodiments, the distal end 220 of the barrier layer may be configured to extend downwards and/or outwards from the interior region of the lower garment to or towards an article of footwear that the subject is wearing when the barrier layer is deployed. In some cases, when the barrier layer is deployed from the lower garment, the distal end 220 may not or need be attached or coupled to the inner layer or lining of the lower garment, and may hang freely from the lower garment until the distal end 220 is detachably secured to the article of footwear. In some cases, the distal end 220 of the barrier layer may be moved upwards and/or inwards into the interior region of the lower garment for storage. In some embodiments, when the barrier layer is positioned inside or within the interior region of the lower garment for storage, the distal end 220 of the barrier layer may be detachably securable to the inner layer or lining of the lower garment (e.g., using one or more fasteners or attachment mechanisms as described elsewhere herein).

In some embodiments, the barrier layer may be configured to rotate, pivot, fold, or articulate about a lateral axis corresponding to or coinciding with an attachment interface between the proximal end of the barrier layer and the interior region of the lower garment. In some embodiments, the barrier layer may be configured to rotate, pivot, fold, or articulate about the attachment interface between the proximal end of the barrier layer and the interior region of the lower garment as the barrier layer transitions between a deployed state/configuration and a stored state/configuration.

Elastic Portion

In some embodiments, the barrier layer may comprise an elastic portion 230 provided between the proximal end 210 and the distal end 220 of the barrier layer. In some embodiments, the elastic portion 230 may be directly integrated into the main body of the barrier layer.

In some embodiments, the elastic portion 230 may comprise a stretchable, elastic, and/or flexible material. In some embodiments, the elastic portion 230 may comprise a different material than the proximal end 210 and/or the distal end 220 of the barrier layer. In some embodiments, the elastic portion 230 may have a greater stretchability, elasticity, or flexibility than the proximal end 210 and/or the distal end 220 of the barrier layer. In some embodiments, the elastic portion 230 may comprise a different material than the outer and/or inner layers of the lower garment. In some embodiments, the elastic portion 230 may have a greater stretchability, elasticity, or flexibility than the outer and/or inner layers of the lower garment.

In some embodiments, the elastic portion 230 may be configured to enhance a stretchability of the barrier layer or a flexibility of the distal end 220 of the barrier layer relative to the proximal end 210 of the barrier layer. In some embodiments, the elastic portion 230 may be configured to stretch to a plurality of different lengths to allow the distal end 220 of the barrier layer to engage with a plurality of different sections or segments of a lace assembly or a cable system associated with an article of footwear. In some embodiments, the distal end of the barrier layer may comprise a fastener configured to engage with the plurality of different sections or segments of the lace assembly or cable system of the article of footwear. In some embodiments, the fastener may be integrated with or integrally formed with the barrier layer or a portion thereof. In some non-limiting embodiments, the fastener may be attached or coupled to one or more panels of the barrier layer (e.g., using an adhesive material).

In some embodiments, the elastic portion 230 of the barrier layer may be positioned (i) within the interior region of the one or more leg portions of the lower garment and (ii) above a bottom edge of the one or more leg portions of the lower garment when the barrier layer is extended downwards to cover the instep or vamp region of the article of footwear. In some embodiments, the elastic portion 230 of the barrier layer may be positioned above the bottom edge of the one or more leg portions of the lower garment when the barrier layer is moved upwards, positioned within, and/or tucked into the interior region of the lower garment.

In some embodiments, the elastic portion 230 of the barrier layer may be positioned above the instep region of a subject's foot or above the vamp region of the article of footwear when the barrier layer is deployed. In some embodiments, the elastic portion 230 of the barrier layer may not or need not extend below the subject's foot or below the sole assembly of the article of footwear. In some embodiments, the elastic portion 230 of the barrier layer may be positioned entirely above the bottom surface of the subject's foot and the sole assembly, and may not or need not extend or wrap around the bottom surface portion of the subject's foot or the sole assembly.

Multi-Layer Construction

In some embodiments, the barrier layer may comprise one or more layers or panels of material. In some cases, the one or more layers or panels may include a plurality of layers or panels that are attached or coupled to each other. In some cases, the plurality of layers or panels may be bonded to or fused with each other. In some cases, the plurality of layers or panels may be attached or coupled to each other using one or more adhesives. In some cases, the plurality of layers or panels may be stitched or sewn together. In some cases, the layers or panels may comprise one or more materials. In some cases, the layers or panels may comprise two or more different materials.

In some embodiments, the barrier layer may comprise an outer layer. In some cases, the outer layer may be a waterproof or water-resistant layer that is directly exposed to an external environment. In some cases, the outer layer may be impermeable or semi-permeable to solids, liquids, and/or gases. In some cases, the outer layer may be selectively permeable or semi-permeable in different directions through the outer layer. In some cases, the outer layer may be selectively permeable in a first direction from an inner side of the outer layer to an outer side of the outer layer to (1) enhance the breathability of the barrier layer and (2) expel or remove any unwanted moisture that has formed or collected inside or within the lower garment or the article of footwear (e.g., due to condensation of water vapor and/or perspiration). In some cases, the outer layer may be impermeable in a second direction from the outer side of the outer layer to the inner side of the outer layer in order to prevent a movement or ingress of water, moisture, and/or precipitation into the interior region(s) of the lower garment and/or the article of footwear.

In some embodiments, the barrier layer may comprise one or more inner layers. In some cases, the one or more inner layers may be positioned between the outer layer of the barrier layer and the subject's body. In some cases, the one or more inner layers of the barrier layer may comprise a different material than the outer layer of the barrier layer.

In some non-limiting embodiments, the one or more inner layers may comprise an insulating material. In some cases, the insulating material may comprise a natural insulating material (e.g., fleece, wool, down, etc.). In some cases, the insulating material may comprise a synthetic insulating material. In some cases, the synthetic insulating material may comprise a cluster-fiber insulation (formed of fiber balls that mimic tufts of down), a short-staple insulation (made of short fibers that can move independently), and/or a continuous-filament insulation (formed of a continuous filament that intertwines with itself to create a mass of insulating fibers).

Shape

As shown in FIG. 2, in some embodiments, the barrier layer may comprise a first side 211 and a second side 212 extending between the proximal end 210 and the distal end 220 of the barrier layer. In some cases, the first side 211 of the barrier layer and the second side 212 of the barrier layer may be parallel. In some cases, the first side 211 of the barrier layer and the second side 212 of the barrier layer may be non-parallel.

In some cases, the first side 211 of the barrier layer may be non-perpendicular with the proximal end 210 and/or the distal end 220 of the barrier layer. In other cases, the first side 211 of the barrier layer may be perpendicular with the proximal end 210 and/or the distal end 220 of the barrier layer. In some cases, the second side 212 of the barrier layer may be non-perpendicular with the proximal end 210 and/or the distal end 220 of the barrier layer. In other cases, the second side 212 of the barrier layer may be perpendicular with the proximal end 210 and/or the distal end 220 of the barrier layer.

In some cases, the first side 211 and/or the second side 212 of the barrier layer may include at least one linear portion or section. In some cases, the first side 211 and/or the second side 212 of the barrier layer may include at least one curved or non-linear portion or section. In some cases, the first side 211 and/or the second side 212 of the barrier layer may include at least one linear portion or section and at least one curved or non-linear portion or section.

In some cases, the proximal end 210 and/or the distal end 220 of the barrier layer may include at least one linear portion or section. In some cases, the proximal end 210 and/or the distal end 220 of the barrier layer may include at least one curved or non-linear portion or section. In some cases, the proximal end 210 and/or the distal end 220 of the barrier layer may include at least one linear portion or section and at least one curved or non-linear portion or section.

In some embodiments, the barrier layers described herein may have a flat or substantially flat surface contour or profile. In other embodiments, the barrier layers of the present disclosure may have a curved surface contour or profile that conforms to a shape or a profile of (i) an instep region of a subject's foot and/or (ii) a vamp region of an article of footwear worn by the subject. In some embodiments, the presently disclosed barrier layers may be flexible and/or deformable to allow the barrier layers to transition between a flat or substantially flat surface contour or profile (e.g., when the barrier layer is stored away in the interior region of the lower garment) and a curved surface contour or profile (e.g., when the barrier layer is deployed over the instep or vamp region).

In some embodiments, the barrier layers described herein may have a length. In some cases, the length may correspond to a vertical length of the barrier layers when the barrier layers are fully extended. In some cases, the vertical length may be at least about 60 millimeters (mm), at least about 70 mm, at least about 80 mm, at least about 90 mm, at least about 100 mm, or more. In some cases, the length of the barrier layers may be sufficient to cover an entire instep region of the subject's foot or an entire vamp region of the article of footwear (e.g., from the bottom or lower throat region of the article of footwear to at least the upper throat region of the article of footwear).

In some embodiments, the barrier layers of the present disclosure may have a width. In some cases, the width may correspond to a lateral width of the barrier layers when the barrier layers are fully extended in a lateral direction. In some cases, the lateral width may be at least about 100 mm, at least about 110 mm, at least about 120 mm, at least about 130 mm, at least about 140 mm, at least about 150 mm, or more. In some cases, the width of the barrier layers may be sufficient to cover an entire instep region of the subject's foot or an entire vamp region of the article of footwear (e.g., from a medial side of the article of footwear to a lateral side of the article of footwear or vice versa). In some cases, the width of the barrier layers may gradually change or vary along a length of the barrier layer.

Magnetic Attachment

In some embodiments, the barrier layer may be attachable or affixable to an interior region of the lower garment to secure and/or retain the barrier layer within the interior region of the lower garment. In some embodiments, the barrier layer may be attachable or affixable to the interior region of the lower garment to restrict or limit a movement of the barrier layer when the barrier layer is positioned within the interior region of the lower garment.

As shown in FIG. 2, in some embodiments, the barrier layer may include a plurality of attachment mechanisms 250 integrated with the barrier layer. In some embodiments, the plurality of attachment mechanisms 250 may be integrated within a main body portion of the barrier layer. In some embodiments, the plurality of attachment mechanisms 250 may be positioned between two or more layers or panels of the barrier layer so that the attachment mechanisms are not externally visible or directly exposed to an external environment when the barrier layer is deployed.

In some embodiments, the plurality of attachment mechanisms 250 may be positioned between a first surface portion and a second surface portion of the barrier layer. In some cases, the first surface portion may correspond to an outer surface of the barrier layer (i.e., a surface of the barrier layer that is directly exposed to a surrounding environment when the barrier layer is deployed). In some cases, the second surface portion may correspond to an inner surface of the barrier layer (i.e., a surface of the barrier layer that is positioned directly over and adjacent to the instep or vamp region of the article of footwear when the barrier layer is deployed).

In some non-limiting embodiments, the plurality of attachment mechanisms 250 may include one or more magnetic attachments. In some cases, the one or more magnetic attachments may be configured to detachably couple a distal end of the barrier layer to an interior region of the one or more leg portions of the lower garment. In some cases, the one or more magnetic attachments may be used to hide or conceal the barrier layer within the interior region of the one or more leg portions of the lower garment.

In some embodiments, the lower garments described herein may comprise a plurality of complementary attachment mechanisms (e.g., magnets) configured to engage with the plurality of magnetic attachments integrated with the barrier layer (e.g., to retain the barrier layer within the interior or inner region of the lower garment). In some cases, the plurality of complementary attachment mechanisms may be integrated into a layer or a panel of the lower garment. In some cases, the plurality of complementary attachment mechanisms may be attached to an interior or inner region of the one or more leg portions of the lower garment. In some cases, the plurality of complementary attachment mechanisms may be positioned between two or more layers or panels of the lower garment.

Fastener

In some embodiments, the barrier layer may include a fastener for selectively engaging a lace assembly or a cable system associated with the article of footwear worn by the subject. In some embodiments, the article of footwear may include a shoe, a boot, a sandal, a slipper, or any other article with a sole component (e.g., an insole, a midsole, and/or an outsole) that can support, cushion, or protect the subject's foot.

Figure 3A:
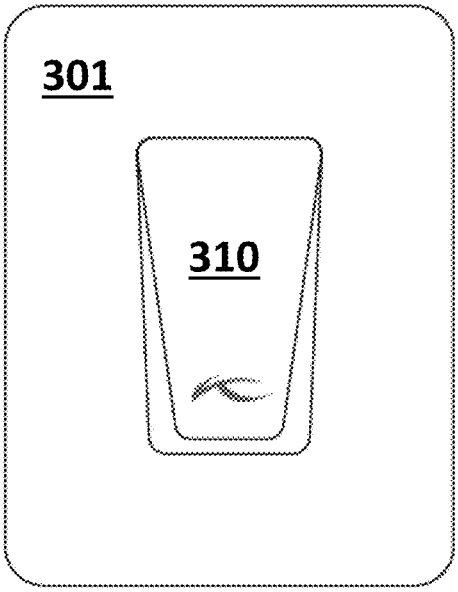
FIGS. 3A and 3B schematically illustrate a detailed view of a fastener for detachably coupling the deployable barrier layer to a lace assembly or a cable system of an article of footwear, in accordance with some embodiments.
Figure 3B:
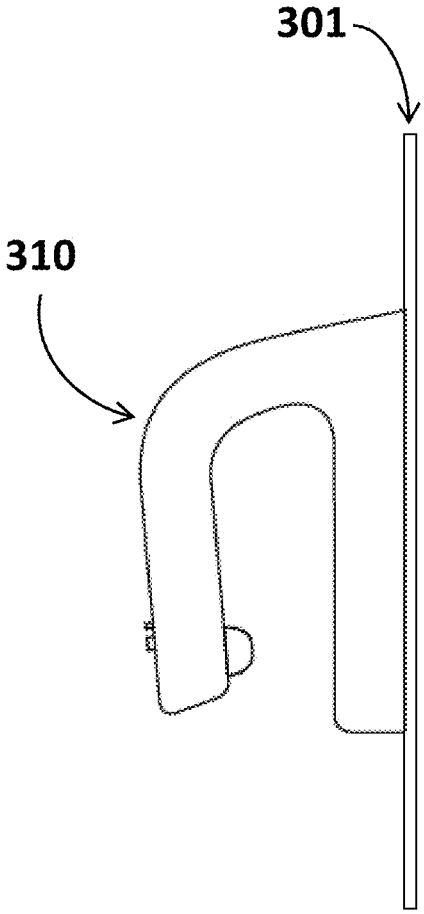

FIGS. 3A and 3B schematically illustrate an example of a barrier layer 301 with a fastener 310 that can be used to engage a lace assembly or a cable system associated with an article of footwear. In some cases, the fastener 310 may be disposed on a first side of the barrier layer 301 that is opposite a second side of the barrier layer. In some cases, the first side of the barrier layer 301 may correspond to a side of the barrier layer 301 that is positioned directly over and adjacent to the instep or vamp region of the article of footwear when the barrier layer 301 is deployed. In some cases, the second side of the barrier layer 301 may correspond to a side of the barrier layer 301 that is directly exposed to a surrounding environment external to the lower garment and the article of footwear when the barrier layer 301 is deployed.

In some non-limiting embodiments, the fastener may comprise a hook or a latch. In some alternative or optional embodiments, the fastener may comprise a magnetic element or one or more snap fitting elements configured to interface or engage with a complementary element disposed on the article of footwear. In some cases, the complementary element may be attached or coupled to the upper, the tongue, the throat region, or the toe box of the article of footwear. In some cases, the complementary element may be attached or coupled to a lace assembly or a cable system of the article of footwear.

In some cases, the fastener may be manipulated to engage with the lace assembly or the cable system of the article of footwear. In some cases, the fastener may be configured to keep the barrier layer in a tensioned state around, along, or over the instep or vamp region so that the barrier layer remains secured to the article of footwear even during movement. In some cases, the fastener may be configured to keep the barrier layer in a fully extended state to ensure full coverage of the instep or vamp region at all times.

In some cases, the fastener may be manipulated to disengage with the lace assembly or the cable system of the article of footwear. In some cases, the fastener may be manipulated to detach or decouple the barrier layer from the article of footwear so that the barrier layer can be retracted into or hidden/stored within an interior region of the lower garments disclosed herein.

In some non-limiting embodiments, the fastener may have a fixed position and/or a fixed orientation. In other non-limiting embodiments, the fastener may be movable or adjustable. In some cases, the fastener may be configured to translate laterally so that the fastener can engage with multiple different sections or segments of the lace assembly or the cable system of the article of footwear. In some cases, the fastener may be configured to rotate, swivel, pivot, and/or articulate about one or more axes in three-dimensional space so that the position and/or the orientation of the fastener can be adjusted for engagement with different sections or segments of the lace assembly or the cable system.

In some non-limiting embodiments, the barrier layer may include a single fastener disposed on or integrated with the barrier layer. In some embodiments, the single fastener may be used to detachably couple the barrier layer to either one of or both (i) the lace assembly or cable system of the article of footwear and (ii) the interior region of the lower garment.

In some non-limiting embodiments, the barrier layer may include a plurality of fasteners disposed on or integrated with the barrier layer. In some embodiments, the plurality of fasteners may be configured to simultaneously and/or independently engage with a plurality of different sections or segments of a lace assembly or a cable system associated with an article of footwear. In some embodiments, the plurality of fasteners may be configured to simultaneously and/or independently engage with multiple different interior portions or regions of the lower garment.

In some optional or alternative embodiments, the lower garment may comprise one or more additional fasteners. In some embodiments, the one or more additional fasteners may be configured to couple a bottom edge of the one or more leg portions of the lower garment to one or more select regions of the article of footwear. In some cases, the one or more select regions may include, for example, a heel region or a rearfoot region of the article of footwear. In other cases, the one or more select regions may include a medial side and/or a lateral side of the article of footwear.

Operation

In some embodiments, when a subject wearing the lower garment wishes to deploy the barrier layer, the subject may detach or decouple the distal end of the barrier layer from the interior region of the lower garment to allow the barrier layer to be deployed or released from the interior region of the lower garment. In some embodiments, the barrier layer may be configured to deploy downwards automatically by way of gravity and hang freely from an attachment point located within or along an interior region of the lower garment when the distal end of the barrier layer is detached or decoupled from the interior region of the lower garment.

In some embodiments, when a subject wearing the lower garment wishes to store the barrier layer, the subject may move the barrier layer upwards into the interior region of the lower garment for compact storage within the interior region of the lower garment. In some non-limiting embodiments, one or more fasteners (e.g., magnetic fasteners) may be used to secure a distal end of the barrier layer to the interior region of the lower garment to hide the barrier layer out of view when the barrier layer is not in use, and to keep the barrier layer out of the way for maximum freedom of movement.

Deployment

Figure 4A:
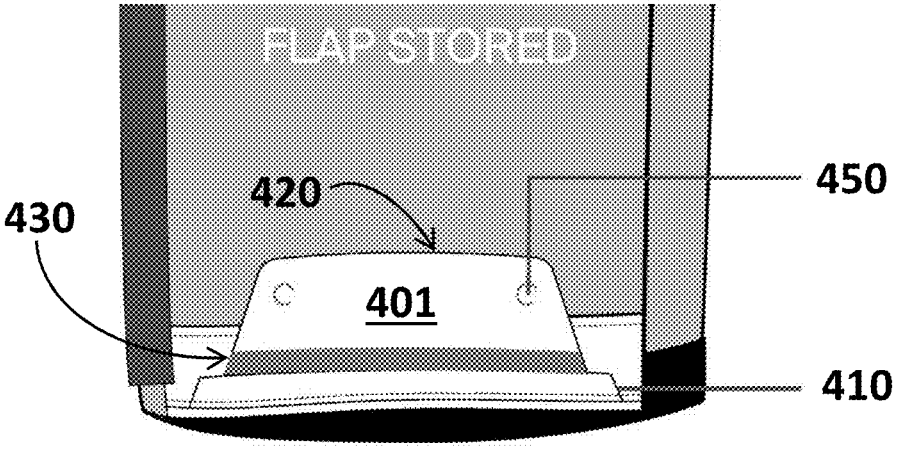
FIGS. 4A-4B and 5A-5B schematically illustrate a deployable barrier layer that can be stored within an interior region of a lower garment and extended downwards to cover a select portion of an article of footwear worn by a subject, in accordance with some embodiments.
Figure 4B:
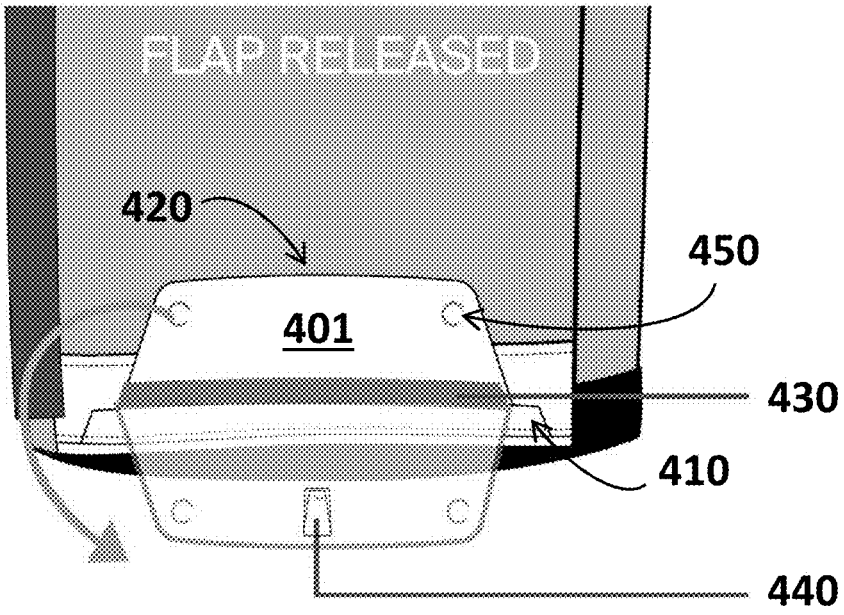
Figure 5A:
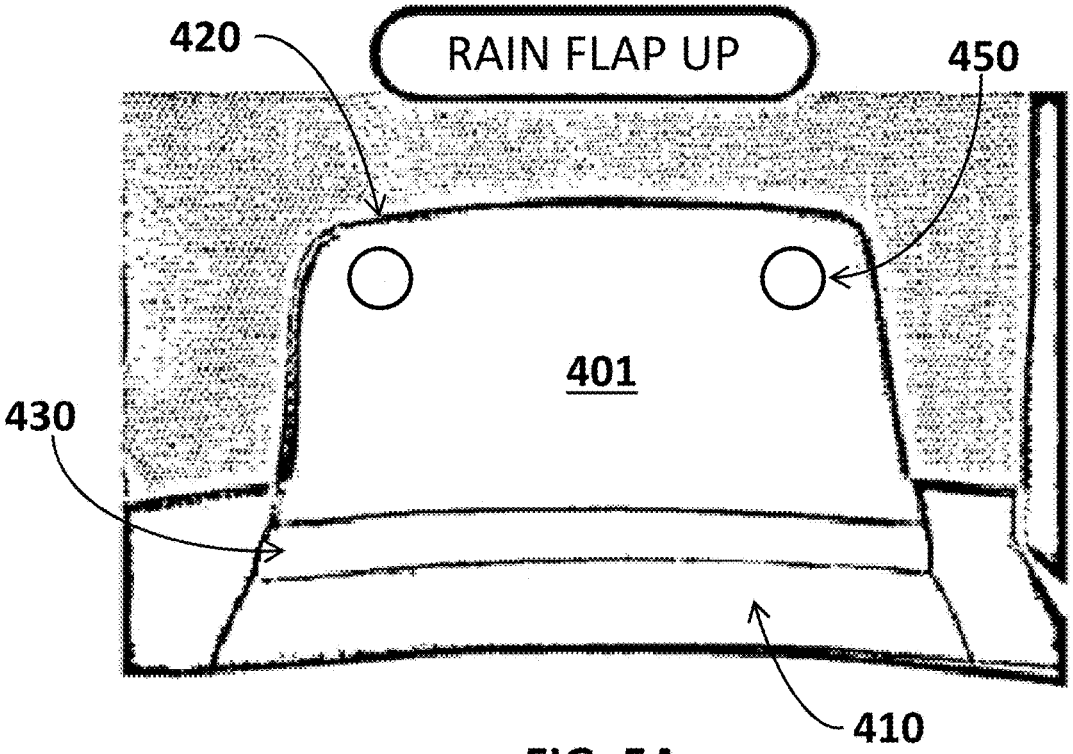
Figure 5B:
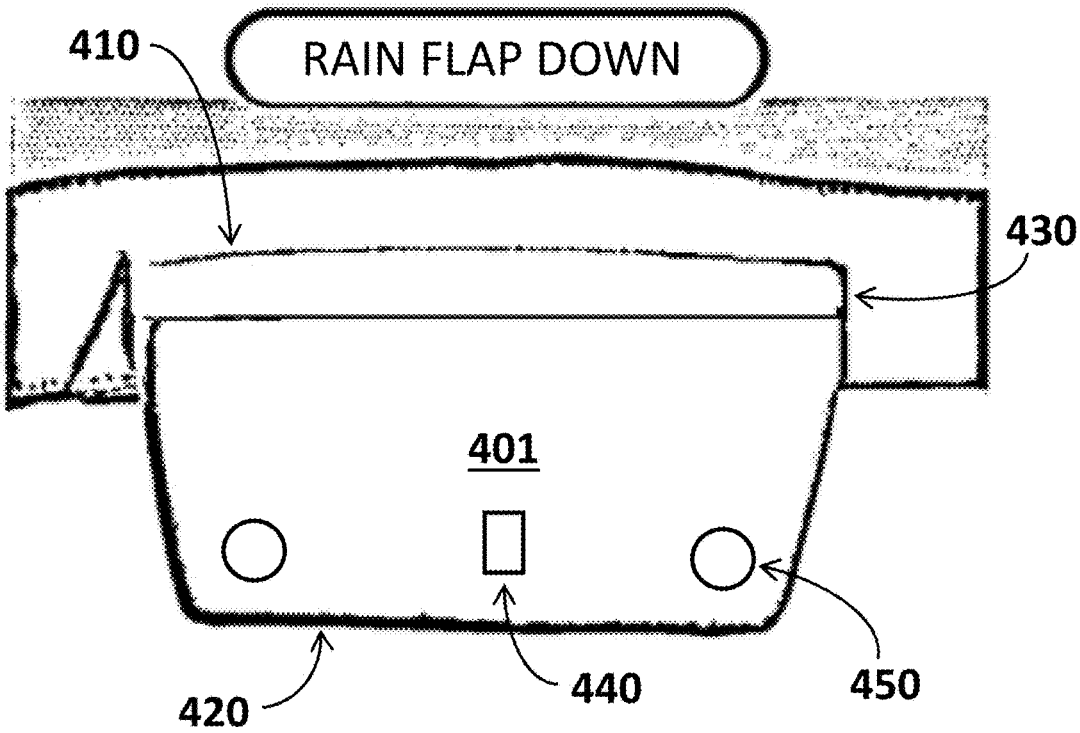

In some embodiments (e.g., as shown in FIGS. 4A and 5A), the barrier layer 401 may be positioned or stored within the interior region of the lower garment. In some embodiments (e.g., as shown in FIGS. 4B and 5B), the distal end of the barrier layer 401 may be detached or separated from the interior region of the lower garment so that the barrier layer can be drawn down and out of the interior region for deployment. Once the distal end of the barrier layer 401 is detached from the interior region of the lower garment, the barrier layer 401 may be pulled or extended downwards (e.g., by way of gravity and/or manipulation by a subject) to fully deploy the barrier layer from the interior region. In some embodiments, a portion of the barrier layer 401 (e.g., a proximal end of the barrier layer) may remain attached to the interior region of the lower garment after the distal end of the barrier layer 401 is detached or separated from the interior region of the garment. In some embodiments, the barrier layer 401 may be configured to hang downwards from an attachment point coupling the proximal end 410 of the barrier layer 401 to the interior region of the lower garment. In some embodiments, the proximal end of the barrier layer 401 may be configured to hang downwards from this attachment point when the distal end of the barrier layer is detached from the interior region of the lower garment and deployed. When the barrier layer 401 is deployed, the distal end 420 of the barrier layer may be positionable across or over an article of footwear worn by the subject.

In some embodiments, the barrier layer 401 may be deployed downwards by pulling the distal end 420 of the barrier layer towards the article of footwear. In some embodiments, the barrier layer may comprise an elastic portion 430 that enhances a stretchability of the barrier layer so that the barrier layer can extend over an instep region of the subject's foot or the vamp region of the article of footwear. In some embodiments, when the barrier layer 401 is deployed downwards and extended over the instep or vamp region, one or more fasteners 440 may be used to secure the barrier layer 401 to the article of footwear worn by the subject. In some embodiments, securing the barrier layer 401 to the article of footwear may create a physical barrier that extends continuously between the bottom edges of the lower garment and the upper portions or regions of the article of footwear. In some cases, the physical barrier may be configured to limit or prevent a passage of air, wind, dirt, debris, precipitation, water, and/or moisture into the interior regions of (i) the lower garment via the bottom edges of the lower garment and/or (ii) the article of footwear via the top opening or the vamp region of the article of footwear. In some embodiments, the barrier layer 401 may be configured to provide a waterproof or water-resistant cover that shields the interior regions of the lower garment and the article of footwear from exposure to external water, moisture, and/or precipitation.

Concealment

In some embodiments, the barrier layer 401 may be fully hidden or concealed within an interior region of the lower garment without requiring a high level of dexterity or a complex series of steps to prepare the barrier layer 401 for storage. In some embodiments, the barrier layer 401 may be hidable or concealable within an interior region of the lower garment. In some embodiments, at least a portion of the interior region may correspond to an inner panel, an inner layer, or an inner lining of the lower garment.

In some embodiments, the barrier layer 401 may be placed in the interior region of the lower garment when the barrier layer is not needed, required, or desired. In some embodiments, if the barrier layer is in a deployed configuration (e.g., as shown in FIGS. 4B and 5B), the bottom edge or distal end 420 of the barrier layer may be moved or reoriented upwards so that the entire barrier layer can be positioned within the interior region of the lower garment (e.g., as shown in FIGS. 4A and 5A). In some embodiments, when the barrier layer 401 is positioned entirely within the interior region of the lower garment, the barrier layer 401 may not or need not be visible from the exterior of the lower garment. In some embodiments, the barrier layer 401 may be stored within the interior region of the garment and the distal end of the barrier layer may be detachably coupled to an inner surface portion of the garment (e.g., using one or more magnetic attachment mechanisms 450) so that the barrier layer stays out of the way and does not interfere with the subject's movement or the fit, function, comfort, or aesthetics of the lower garment.

Foldable Barrier Layer

In some embodiments, the barrier layer may be configured to move or transition between a stored configuration (e.g., as shown in FIGS. 4A and 5A) and a deployed configuration (e.g., as shown in FIGS. 4B and 5B). In some non-limiting embodiments, the barrier layer may be configured to move or transition between the stored configuration and the deployed configuration by way of a folding motion or action.

In some embodiments, the barrier layer may be foldable to deploy or conceal the barrier layer. In some embodiments, the barrier layer may be configured to extend or unfold downwards from the interior region of the lower garment when the barrier layer is deployed. In some embodiments, the barrier layer may be unfolded and deployed from the interior region of the lower garment so that the distal end of the barrier layer can extend below the bottom edge of the one or more leg portions of the lower garment. In some embodiments, the barrier layer may be configured to fold upwards into the interior region of the lower garment when a subject wearing the lower garment does not need or want to use the barrier layer.

In some embodiments, the barrier layer may be configured to fold about a lateral axis that is positionally offset from a bottom edge of the one or more leg portions of the lower garment. In some embodiments, the barrier layer may be configured to fold about a lateral axis that is positioned above the bottom edge of the lower garment. In some embodiments, the barrier layer may be configured to fold about a lateral axis that extends directly adjacent to the bottom edge of the lower garment.

In some embodiments, the barrier layer and/or any portions thereof may be folded one or more times before the barrier layer is placed within the interior region of the lower garment for storage. In some embodiments, the barrier layer may be foldable on itself to reduce a storage area or volume of the barrier layer. In some cases, the barrier layer may comprise one or more portions or sections that are foldable onto the body of the barrier layer to reduce a storage area or volume of the barrier layer.

Materials

In some embodiments, the barrier layers described herein may comprise a material (also referred to herein as a "barrier layer material"). In some embodiments, the barrier layer material may comprise a waterproof material, a water-resistant material, and/or a water-repellant material. In some embodiments, the barrier layer material may comprise an elastic material, a stretchable material, and/or an expandable material.

In some embodiments, the barrier layer material may include a waterproof, water-resistant, and/or water-repellant material. In some non-limiting embodiments, the waterproof, water-resistant, and/or water-repellant material may comprise a perfluorinated substance and/or a polyfluorinated substance (e.g., a perfluoroalkyl substance or a polyfluoroalkyl substance). In other non-limiting embodiments, the waterproof, water-resistant, and/or water-repellant material may comprise a non-PFAS material (i.e., a material that does not include any perfluorinated or polyfluorinated substances). In some embodiments, the waterproof, water-resistant, and/or water-repellant material may comprise one or more dendrimers, one or more dendrons, and/or one or more compounds comprising one or more dendritic molecules. In some embodiments, the waterproof, water-resistant, and/or water-repellant material may comprise a silicone-based material. In other embodiments, the waterproof, water-resistant, and/or water-repellant material may comprise a hydrocarbon-based material. In some optional embodiments, the waterproof, water-resistant, and/or water-repellant material may comprise a combination of one or more silicone-based materials and one or more hydrocarbon-based materials. In some cases, the waterproof, water-resistant, and/or water-repellant material may include a urethane-based or a polyurethane-based material. In other cases, the waterproof, water-resistant, and/or water-repellant material may include a plurality of fibers forming a knitted or woven textile structure. In some cases, the plurality of fibers may be configured to swell when exposed to a liquid (e.g., water, moisture, precipitation, etc.) in order to close any interstitial gaps between the plurality of fibers forming the knitted or woven textile structure, thereby restricting a movement of water, moisture, and/or precipitation through the knitted or woven textile structure.

In some cases, the barrier layer material may comprise a weather-resistant material. In some cases, the weather-resistant material may comprise a material that is substantially impervious to one or more fluids in a liquid phase, a gaseous phase, or a vapor phase. In some cases, the weather-resistant material may be substantially impervious to wind and/or air currents. In some cases, the weather-resistant material may also be substantially impervious to water, moisture, and/or other precipitation.

In some cases, the barrier layer material may comprise a water-resistant material. In some cases, the water-resistant material may include a material that is impervious or substantially impervious to water, moisture, and/or precipitation. In some cases, the barrier layer material may comprise a hydrophilic or water repellant material. In some cases, the hydrophilic or water repellant material may be provided as a coating on a portion or a section of the barrier layer. In some cases, the coating may prevent water, moisture, and/or precipitation from entering inside the lower garment and/or the article of footwear through the portions or sections of the barrier layer with the coating applied thereon. In some cases, one or more hydrophobic coatings may be applied to the barrier layer to provide a durable water repellent (DWR) layer which can repel any water droplets contacting the barrier layer.

In some cases, the barrier layer material may be impermeable or semi-permeable to solids, liquids, vapors, and/or gases. In some cases, the barrier layer may include a membrane that is selectively permeable or semi-permeable in different directions. In some cases, the membrane may be selectively permeable in a first direction from an inner side of the membrane to an outer side of the membrane in order to (1) enhance the breathability of the barrier layer and (2) expel or remove any unwanted moisture inside or within the lower garment or the article of footwear (e.g., due to condensation of water vapor and/or perspiration). In some cases, the membrane may be impermeable or semi-permeable in a second direction from the outer side of the membrane to the inner side of the membrane in order to prevent a movement of water, moisture, and/or precipitation (e.g., drizzle, rain, sleet, snow, ice pellets, and/or hail) into an interior region of the lower garment or the article of footwear.

In some embodiments, the barrier layer may include an elastic material that is stretchable and/or expandable in one or more directions. In some embodiments, the elastic material may be stretchable and/or expandable in a plurality of different directions. In some non-limiting embodiments, the elastic material may include, for example, a polyester material, a nylon material, and/or an elastane material.

In some embodiments, the barrier layer may comprise a plurality of portions or regions comprising a plurality of different materials. In some non-limiting embodiments, the barrier layer may comprise a first portion or region comprising a waterproof, water-resistant, and/or water-repellant material. In some non-limiting embodiments, the barrier layer may comprise a second portion or region comprising an elastic, stretchable, and/or expandable material. In some embodiments, the first portion or region may correspond to a proximal end and/or a distal end of the barrier layer. In some embodiments, the second portion or region may correspond to one or more elastic regions disposed between the proximal end and the distal end of the barrier layer.

In some cases, a first portion of the barrier layer (e.g., the proximal end and/or the distal end of the barrier layer) may be waterproof, water-resistant, and/or water-repellant. In some cases, a second portion of the barrier layer (e.g., the one or more elastic regions disposed between the proximal end and the distal end of the barrier layer) may be stretchable and/or flexible in one or more directions. In some cases, the first portion of the barrier layer may be stretchable and/or flexible in one or more directions. In other cases, the first portion of the barrier layer may be relatively inflexible or non-elastic and may resist stretching or expansion in one or more directions. In some cases, the second portion of the barrier layer may be waterproof, water-resistant, and/or water-repellant. In other cases, the second portion of the barrier layer may not or need not be waterproof, water-resistant, and/or water-repellant.

In some embodiments, the barrier layer material may be different than a material of the lower garment. In some embodiments, the barrier layer material may be the same material as the lower garment. In some embodiments, the barrier layer may comprise a plurality of portions or regions comprising a plurality of different materials. In some cases, the plurality of portions or regions of the barrier layer may include at least one portion or region made of a same or similar material as the lower garment. In some cases, the plurality of portions or regions of the barrier layer may include at least one portion or region made of a different material than the lower garment.

As described elsewhere herein, in some embodiments, a fastener may be provided on a distal end of the barrier layer to allow the barrier layer to engage with the lace assembly or the cable system of the article of footwear. In some embodiments, the fastener may comprise a fastener material. In some embodiments, the fastener material may be different than the barrier layer material.

In some embodiments, the fastener may comprise a malleable or bendable material. In some embodiments, the fastener may comprise an extendable or extensible material. In some embodiments, the fastener may comprise an elastic or elastomeric material. In some embodiments, the fastener may comprise a soft or deformable material. In some embodiments, the fastener may comprise a durable, stiff, and/or rigid or semi-rigid material that resists bending or deformation.

In some embodiments, the fastener may comprise a metallic material. In some embodiments, the metallic material may include one or more of aluminum, magnesium, titanium, iron, copper, silver, and/or gold. In some non-limiting embodiments, the fastener may comprise an intermetallic material. The intermetallic material may include, for example, steel (iron and carbon), brass (copper and zinc), bronze (copper and tin), duralumin (aluminum and copper), a gold alloy (gold and copper, zinc, nickel, iron, cadmium, aluminum, silver, platinum, and/or palladium), or nichrome (nickel and chromium).

In some embodiments, the fastener may comprise a plastic material. In some embodiments, the plastic material may include, for example, polyurethane (PU), thermoplastic polyurethane (TPU), polyethylene terephthalate (PET), polypropylene (PP), polycarbonate (PC), polyvinyl chloride (PVC), or any other suitable plastic compound comprising one or more polymers or polymer chains or networks.

In some embodiments, the fastener may comprise a rubber material. In some embodiments, the rubber material may include, for example, a polybutadiene rubber, a polyisoprene rubber, an ethylene-propylene rubber ("EPR"), an ethylene-propylene-diene ("EPDM") rubber, a styrene-butadiene rubber ("SBR"), a styrenic block copolymer rubber (such as "SI", "SIS", "SB", "SBS", "SIBS", "SEBS", "SEPS" and the like, where "S" is styrene, "I" is isobutylene, "E" is ethylene, "P" is propylene, and "B" is butadiene), a butyl rubber, a nitrile rubber, or any other suitable natural or synthetic rubber compound.

In some embodiments, the fastener may comprise a composite material. In some embodiments, the composite material may include a matrix or a network of reinforcing fibers. In some embodiments, the reinforcing fibers may comprise one or more carbon fibers, one or more aramid fibers, one or more glass fibers, and/or one or more metallic or intermetallic fibers.

Figure 6:
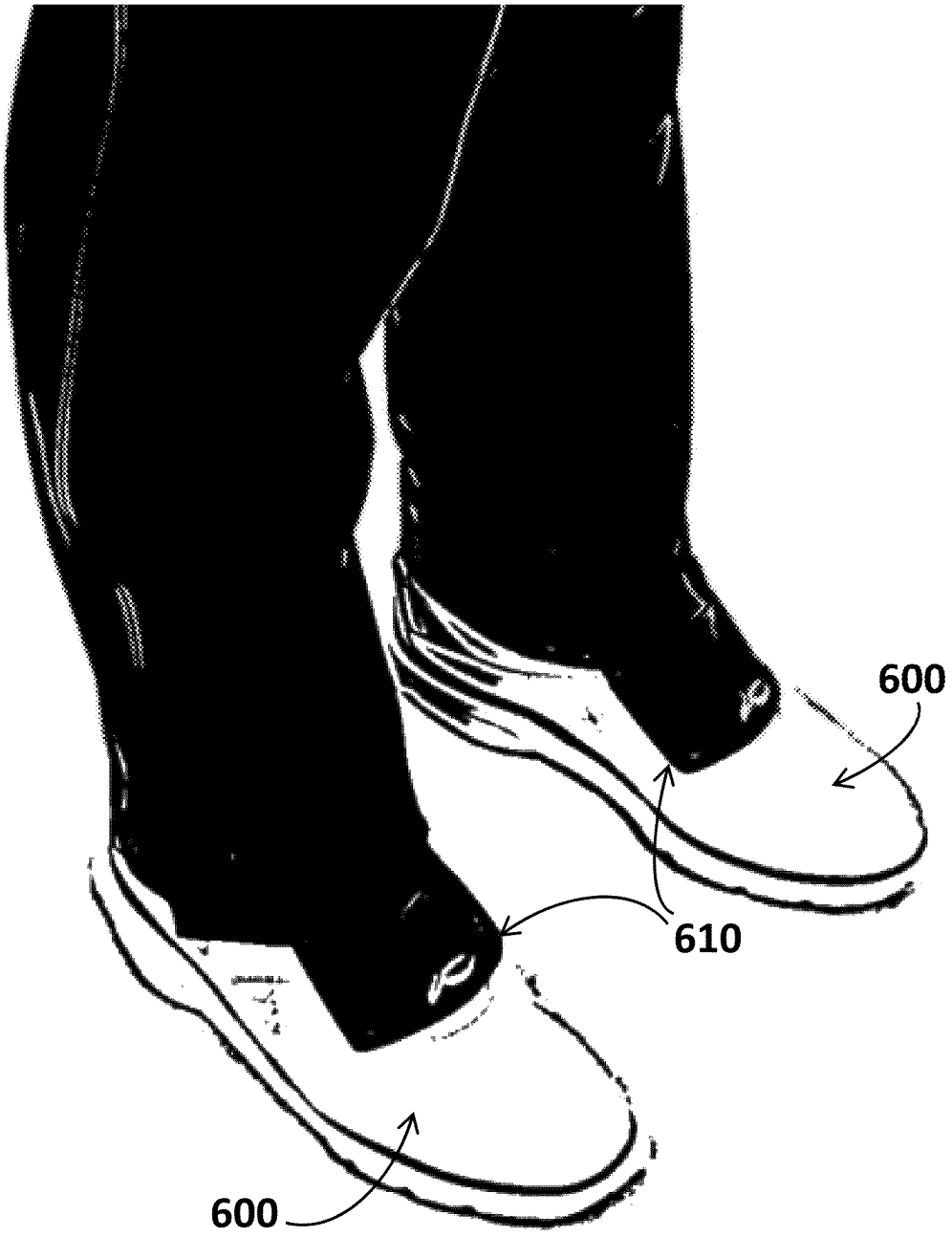
FIG. 6 schematically illustrates an example of a garment or article with a deployable barrier layer that can be detachably coupled to an article of footwear, in accordance with some embodiments.

FIG. 6 schematically illustrates an example of an article of footwear 600 that can be worn in conjunction with the lower garments of the present disclosure. In some embodiments, the lower garments may comprise a deployable barrier layer 610 as described elsewhere herein. In some embodiments, the deployable barrier layer 610 may be detachably coupled to the article of footwear 600. In some embodiments, the deployable barrier layer 610 may include one or more fasteners configured to engage with a lace assembly or a cable system of the article of footwear 600 to secure the barrier layer 610 to the article of footwear 600.

In some embodiments, the barrier layer may be deployed from the interior region of the lower garment and extended to cover a portion of the article of footwear. When the barrier layer is deployed and extended, the proximal end of the barrier layer may be positioned near a bottom edge of the one or more leg portions of the lower garment, between the interior region of the lower garment and an upper portion of the subject's foot or the article of footwear. When the barrier layer is deployed and extended, the distal end of the barrier layer may be positioned over a vamp region of the article of footwear and/or over an instep region of the subject's foot.

In some embodiments, the barrier layer may be secured to a lace assembly or a cable system of the article of footwear using one or more fasteners that are attached or coupled to the barrier layer. In some cases, the one or more fasteners may help to keep the barrier layer in a tensioned state around or along the instep or vamp region so that the barrier layer remains secured to the article of footwear even when the subject is moving. In some cases, the one or more fasteners may help to keep the barrier layer in a fully extended state to ensure full coverage of the instep or vamp region at all times. Once the barrier layer is secured to the article of footwear, the barrier layer may be configured to wrap around and conform to an underlying shape or profile of the article of footwear or the subject's foot.

In some embodiments, when the subject wearing the lower garment wishes to stow away the barrier layer, the subject may unfasten the connection between the barrier layer and the lace assembly or cable system of the article of footwear, and reposition the barrier layer within the interior region of the lower garment. Once the barrier layer is positioned within the interior region of the lower garment, the barrier layer may be detachably secured to an inner surface portion of the interior region and stowed or hidden away to prevent any damage to the barrier layer, and to avoid restricting or hindering the subject's ability to move his or her lower body or feet.

Although specific embodiments are described herein, one of skill in the art will appreciate that these articles are provided for illustrative purposes, and that other articles may be employed to perform the functionalities disclosed herein without departing from the scope of the disclosure. Moreover, while different examples and embodiments may be described separately, such embodiments and examples may be combined with one another to implement the technology described herein. One skilled in the art will recognize other embodiments or improvements that are within the scope and spirit of the present disclosure. It is intended that all such embodiments and improvements be covered by the appended claims.

What is claimed is:

1. An article of apparel comprising:

a lower garment comprising one or more leg portions with a bottom cuff comprising a shortened front cuff portion and a rain flap attached to or integrally formed with the shortened front cuff portion of the bottom cuff, wherein the rain flap has a proximal end attached to the bottom cuff of the lower garment and a distal end that is configured to cover an upper portion of an article of footwear worn by a subject wearing the article of apparel, wherein the rain flap further comprises:

(i) an elastic portion provided between the proximal end and the distal end of the rain flap to enhance a stretchability of the rain flap or a flexibility of the distal end relative to the proximal end, wherein the elastic portion is positionable over the upper portion of the article of footwear;

(ii) a fastener for engaging a lace or a cable associated with the article of footwear; and (iii) a plurality of magnetic attachment mechanisms integrated with the distal end of the rain flap, wherein the plurality of magnetic attachment mechanisms are configured to detachably couple the distal end of the rain flap to an interior region of the one or more leg portions of the lower garment to hide or conceal the rain flap.

2. The article of apparel of claim 1, wherein the distal end of the rain flap is configured to cover a lateral side portion of the article of footwear.

3. The article of apparel of claim 2, wherein the distal end of the rain flap is configured to cover a medial side portion of the article of footwear.

4. The article of apparel of claim 1, wherein the fastener comprises a hook or a latch.

5. The article of apparel of claim 4, wherein the hook or latch has a fixed position or orientation.

6. The article of apparel of claim 1, wherein the proximal end of the rain flap is attached to the interior region of the one or more leg portions of the lower garment.

7. The article of apparel of claim 1, wherein the elastic portion of the rain flap is positioned within the interior region of the one or more leg portions and above a bottom edge of the one or more leg portions when the rain flap is extended downwards to cover the upper portion of the article of footwear.

8. The article of apparel of claim 1, wherein the elastic portion comprises a stretchable material comprising elastane.

9. The article of apparel of claim 1, wherein the elastic portion comprises a different material than the proximal end or the distal end of the rain flap.

10. The article of apparel of claim 1, wherein the distal end of the rain flap comprises a waterproof or water-resistant material.

11. The article of apparel of claim 1, wherein the rain flap is configured to fold about a lateral axis that is positionally offset from a bottom edge of the one or more leg portions of the lower garment.

12. The article of apparel of claim 1, wherein the rain flap comprises a first side and a second side extending between the proximal end and the distal end of the rain flap, wherein the first side of the rain flap and the second side of the rain flap are non-parallel.

13. The article of apparel of claim 12, wherein the first side of the rain flap is non-perpendicular with the proximal end and the distal end of the rain flap.

14. The article of apparel of claim 12, wherein the second side of the rain flap is non-perpendicular with the proximal end and the distal end of the rain flap.

15. The article of apparel of claim 1, wherein the rain flap is configured to curve around and conform to the upper portion of the article of footwear to form a waterproof or water-resistant barrier.

16. The article of apparel of claim 1, wherein the elastic portion is configured to stretch to a plurality of different lengths to allow the fastener to engage with a plurality of different sections or segments of the lace or the cable associated with the article of footwear.

17. The article of apparel of claim 1, wherein the lower garment comprises a plurality of complementary magnets configured to engage with the plurality of magnetic attachment mechanisms integrated with the distal end of the rain flap.

18. The article of apparel of claim 17, wherein the plurality of complementary magnets are integrated into a layer or a panel of the lower garment.

19. The article of apparel of claim 17, wherein the plurality of complementary magnets are attached to the interior region of the one or more leg portions of the lower garment.

20. The article of apparel of claim 1, wherein the rain flap includes a plurality of fasteners for simultaneously or independently engaging with a plurality of different sections or segments of the lace or the cable associated with the article of footwear.

* * * * *